US006571078B2

(12) United States Patent
Munemori et al.

(10) Patent No.: US 6,571,078 B2
(45) Date of Patent: May 27, 2003

(54) COLOR IMAGE FORMING APPARATUS

(75) Inventors: Seiichi Munemori, Osaka (JP); Yuusuke Morikami, Osaka (JP); Takanobu Yamada, Osaka (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/892,560

(22) Filed: Jun. 28, 2001

(65) Prior Publication Data

US 2002/0003976 A1 Jan. 10, 2002

(30) Foreign Application Priority Data

Jul. 5, 2000 (JP) ..... 2000-203661

(51) Int. Cl.[7] ..... G03G 15/01
(52) U.S. Cl. ..... 399/298; 399/302
(58) Field of Search ..... 399/302, 308, 399/298

(56) References Cited

U.S. PATENT DOCUMENTS 5,287,160 A 2/1994 Dastin et al.
5,802,422 A 9/1998 Hokari
5,946,525 A 8/1999 Okamura et al.
6,029,033 A 2/2000 Kawasaki
6,049,350 A 4/2000 Yamaguchi
6,061,542 A 5/2000 Minami et al.
6,341,205 B1 * 1/2002 Yoshino et al. ..... 399/101
6,360,073 B1 * 3/2002 Eelen ..... 399/327

FOREIGN PATENT DOCUMENTS

JP 7-28294 1/1995

* cited by examiner

*Primary Examiner*—Quana M. Grainger
(74) *Attorney, Agent, or Firm*—Morrison & Foerster, LLP

(57) ABSTRACT

A color image forming apparatus of the present invention comprises: an intermediate transfer member being driven to rotate by a driving roller; a plural image forming units for forming superposed toner images on the intermediate transfer member, the plural image forming units being located below the intermediate transfer belt; a transfer member for transferring the superposed toner images formed on the intermediate transfer member onto a sheet of paper in a transfer area; and a pair of rotatable conveyance rollers for conveying the paper to the transfer area in synchronization with the superposed toner images on the intermediate transfer member, wherein a first distance from a image forming position, for the image forming unit located most-downstream in the plural image forming units relative to the movement of the intermediate transfer member, to the transfer area is longer than a second distance from a nipping area formed by the pair of conveyance rollers to the transfer area.

20 Claims, 3 Drawing Sheets

COLOR IMAGE FORMING APPARATUS

RELATED APPLICATIONS

The present invention is based on Japanese Patent Application No. 2000-203661, each contents of which being incorporated by reference.

BACKGROUND OF THE INVENTION

1. Field of the Invention

The present invention relates to a so-called tandem-type color image forming apparatus.

2. Description of the Related Art

As disclosed in U.S. Pat. No. 6,029,033, for example, in a conventional tandem-type color image forming apparatus, multiple image forming units that each house toner of a different color are aligned side by side above the intermediate transfer belt, toner images of different colors are formed on the image carrier, which comprises a photosensitive drum or similar component, of each image forming unit, and a multi-color combination image is formed by sequentially transferring onto the intermediate transfer belt each toner image from each image forming unit (primary transfer), and by then transferring the multi-color combination image on the intermediate transfer belt onto a sheet of recording paper (secondary transfer). Tandem-type image forming apparatuses of this type are receiving attention as color image forming apparatuses capable of high-speed printing.

On the other hand, Japanese Laid-Open Patent Application Hei 7-28294 discloses a tandem-type color image forming apparatus in which multiple image forming units that each house toner of a different color are aligned side by side below the intermediate transfer belt. In a tandem-type image forming apparatus in which the image forming units are located below the intermediate transfer belt in this fashion, the distance from the primary transfer position to the secondary transfer position, in regard to the image forming unit that is located furthest downstream in terms of the movement of the intermediate transfer belt, may be reduced relative to said distance in a tandem-type image forming apparatus in which the image forming units are aligned above the intermediate transfer belt. Consequently, an image forming apparatus in which the image forming units are located below the intermediate transfer belt offers the advantages that (1) the speed of first image formation may be increased. Such a construction when the image forming operation is stopped due to a problem such as a paper jam, (2) there are fewer toner images formed on the intermediate transfer belt, enabling the amount of wasted toner to be reduced, (3) it is easy to reduce the distance from the secondary transfer position to the fusing device, and (4) printing on small-size paper such as postcards may be performed.

In a tandem-type image forming apparatus of this type, the intermediate transfer belt is rotated using a driving roller. Single-color images are formed by each image forming unit on the intermediate transfer belt, and the combination image is then transferred onto a sheet of paper. The sheet of paper is conveyed to an area at which the combination image is transferred thereto via the rotation of the conveyance rollers. The conveyance rollers are driven to rotate together with the driving roller for the intermediate transfer belt. After the combination image is thermally fixed onto the sheet of paper, the sheet of paper is ejected onto a paper eject tray.

However, in a tandem-type image forming apparatus in which the image forming units are located below the intermediate transfer belt, because the load on the conveyance rollers changes from when a sheet of paper is being conveyed by the conveyance rollers rotating to when the sheet of paper has passed through them, the rate of rotation of the driving roller, which is driven by the same driving means as the conveyance rollers, fluctuates, leading to changes in the rate of rotation of the intermediate transfer belt. Where the rate of rotation of the intermediate transfer belt fluctuates, the problem arises that the single-color images formed on the intermediate transfer belt by the image forming units become disturbed, resulting in incomplete overlap of the images of the different colors.

SUMMARY

An object of the present invention is to provide an image forming apparatus that, even when the rate of rotation of the intermediate transfer belt fluctuates when the sheet of paper passes through the conveyance rollers, does not cause misalignment of the single-color images formed on the intermediate transfer belt.

Another object of the present invention is to provide an image forming apparatus in which (1) the speed of first image formation may be increased, (2) the amount of toner wasted in the. event of cessation of an image forming operation due to a problem such as a paper jam may be reduced, and (3) printing on small-size sheets such as postcards is enabled.

The image forming apparatus of the present invention comprises:

- an intermediate transfer belt being supported by a plural rollers including a driving roller and being driven to rotate by the driving roller;
- a first image forming unit being located below the intermediate transfer belt, and forming a first toner image of a first color on the intermediate transfer belt at a first image forming position;
- a second image forming unit being located below the intermediate transfer belt and being located downstream of the first image forming unit relative to the movement of the intermediate transfer belt, the second image forming unit forming a second toner image of a second color over the first toner image formed on the intermediate transfer belt at a second image forming position;
- a third image forming unit being located below the intermediate transfer belt and being located downstream of the second image forming unit relative to the movement of the intermediate transfer belt, the third image forming unit forming a third toner image of a third color over the first and second toner images formed on the intermediate transfer belt at a third image forming position;
- a fourth image forming unit being located below the intermediate transfer belt and being located downstream of the third image forming unit relative to the movement of the intermediate transfer belt, the fourth image forming unit forming a fourth toner image of a fourth color over the first, second and third toner images formed on the intermediate transfer belt at a fourth image forming position;
- a transfer roller for transferring the superposed toner images formed on the intermediate transfer belt onto a sheet of paper in a transfer area, the transfer roller being disposed so as to press against the part of the intermediate transfer belt supported by the driving roller; and a pair of rotatable conveyance rollers for conveying the paper to the transfer area in synchronization with the superposed toner images on the intermediate transfer belt, wherein a first distance from the fourth image forming position for the fourth image forming unit to the transfer area is longer than a second distance from a nipping area formed by the pair of conveyance rollers to the transfer area.

In the image forming apparatus of the present invention, the sheet of paper is conveyed by the conveyance rollers such that the tip of the sheet arrives at the transfer area when the tip of the image formed by the fourth image forming unit reaches the transfer area. The rotational torque supplied by the roller driving device to the driving roller changes when the conveyance of the sheet by the conveyance rollers is completed, and at the same time the rate of rotation of the intermediate transfer belt also changes. Because the fourth image forming unit and the conveyance rollers are respectively located such that the first distance from the fourth image forming position to the transfer area is longer than the second distance from the nipping area formed by the conveyance rollers to the transfer area, when the sheet of paper passes through the conveyance rollers, the fourth image forming unit has completed image formation. Consequently, the effect of the fluctuation in the rate of rotation of the intermediate transfer belt is not reflected in the image transferred to the sheet of paper.

The first distance is slightly longer than the second distance, and the difference between the first and second distances is preferably approximately 10 to 20 mm. Based on this difference, when the sheet of paper is conveyed in synchronization with the combination image formed on the intermediate transfer belt, the sheet conveyance should begin with a slight time difference.

The fourth image forming unit preferably comprises an image forming unit that forms monochrome images. Because misalignment in the overlap of black images is more conspicuous than in images of different colors, this preferred location helps avoid such conspicuous misalignment.

DESCRIPTION OF THE PREFERRED EMBODIMENTS

The embodiments of the present invention are explained below with reference to the accompanying drawings.

Figure 1:
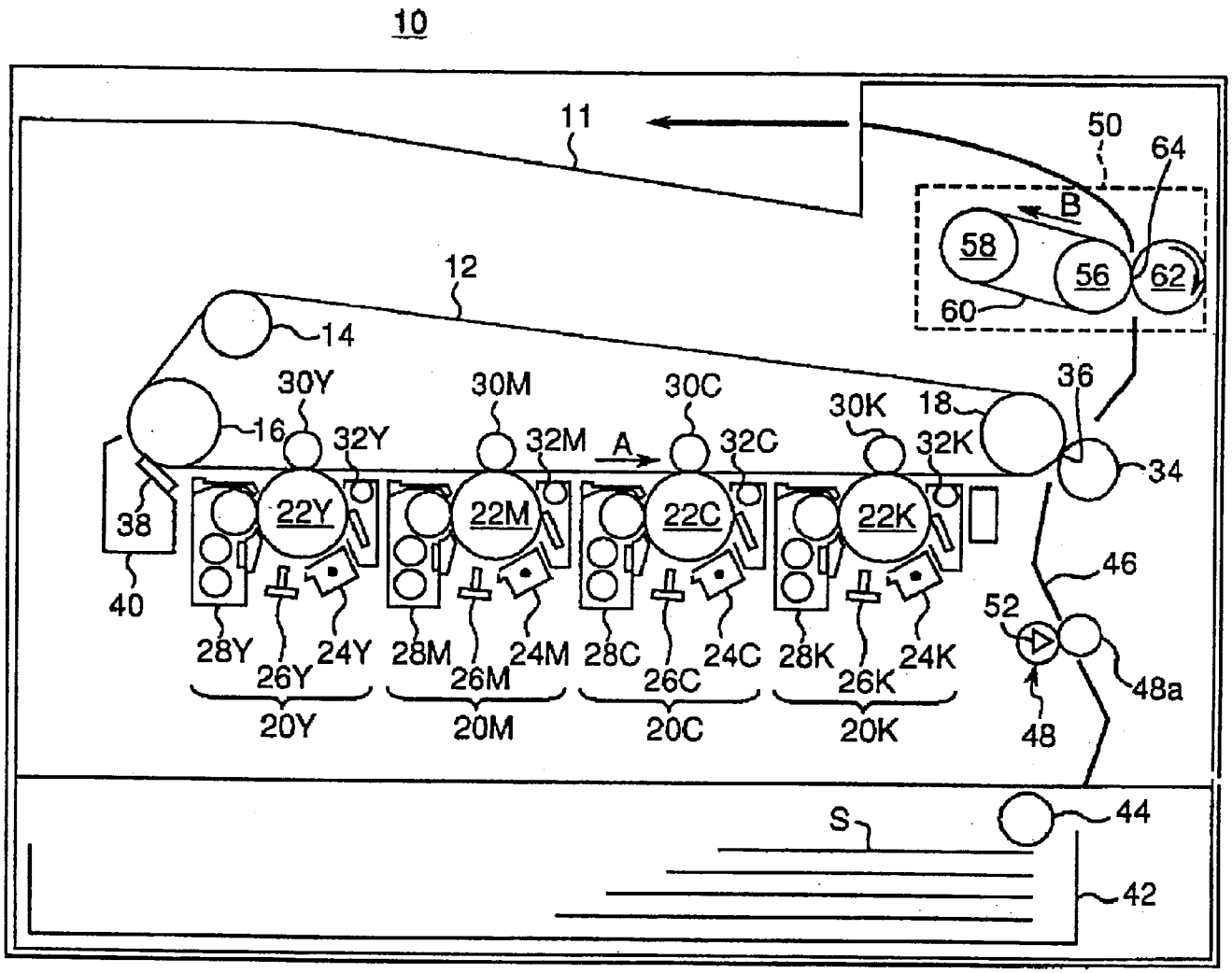
FIG. 1 is a drawing showing the construction of the entire printer comprising an embodiment of the present invention.

FIG. 1 shows the entire construction of the tandem-type digital color printer (hereinafter simply 'printer') 10 comprising an embodiment of the present invention.

The printer 10 has an intermediate transfer belt 12 essentially in the center of its interior. The intermediate transfer belt 12 is supported by the outer circumferences of the rollers 14, 16 and 18. The roller 18 comprises a driving roller that is driven to rotate by a roller driving device 19 (see FIG. 2), and causes the intermediate transfer belt 12 to travel in the direction of the arrow A by supplying rotational torque to the belt.

Fourth image forming units 20Y, 20M, 20C and 20K, which are respectively for yellow (Y), magenta (M), cyan (C) and black (K), are located at a prescribed pitch P along and below the bottom horizontal part of the intermediate transfer belt 12.

The image forming units 20Y, 20M, 20C and 20K have photoreceptor drums 22Y, 22M, 22C and 22K, respectively. Around the photoreceptor drum 22Y are located, sequentially along the rotational circumference thereof, a charger 24Y that uniformly charges the surface of the photoreceptor drum 22Y, a print head 26Y that forms an electrostatic latent image by irradiating the uniformly charged surface of the photoreceptor drum with light in accordance with the image data, a developing unit 28Y that develops the electrostatic latent image formed on the photoreceptor drum surface into a toner image using yellow toner, a primary transfer roller 30Y that faces the photoreceptor drum 22Y via the intermediate transfer belt 12 and that performs primary transfer onto the intermediate transfer belt 12 of the toner image formed on the photoreceptor drum surface via electrostatic attraction, and a cleaner 32Y that collects and cleans off the toner remaining on the photoreceptor drum surface after the primary transfer. Similarly, around the photoreceptor drum 22M are located, sequentially along the rotational circumference thereof, a charger 24M, a print head 26M, a developing unit 28M that develops the electrostatic latent image formed on the photoreceptor drum surface into a toner image using magenta toner, a primary transfer roller 30M and a cleaner 32M. Around the photoreceptor drum 22C are located, sequentially along the rotational circumference thereof, a charger 24C, a print head 26C, a developing unit 28C that develops the electrostatic image formed on the photoreceptor drum surface into a toner image using cyan toner, a primary transfer roller 30C and a cleaner 32C. Around the photoreceptor drum 22K are located, sequentially along the rotational circumference thereof, a charger 24K, a print head 26K, a developing unit 28K that develops the electrostatic image formed on the photoreceptor drum surface into a toner image using black toner, a primary transfer roller 30K and a cleaner 32K. The print heads 26Y, 26M, 26C and 26K each comprise a number of LEDs aligned along the main scanning path parallel to the shaft of the photoreceptor drum.

A secondary transfer roller (transfer member) 34 is in pressure contact with the area of the intermediate transfer belt. 12 supported by the roller 18. The nipping area formed by the secondary transfer roller 34 and the intermediate transfer belt 12 comprises the secondary transfer area 36. A high transfer voltage is impressed to the secondary transfer roller 34. Due to this transfer voltage, the toner image formed on the intermediate transfer belt 12 is electrostatically attracted to the sheet of paper, which comprises the recording medium and has been conveyed to the secondary transfer area 36 in the manner explained below, such that secondary transfer is performed.

A cleaner 38 is in pressure contact with the area of the intermediate transfer belt 12 supported by the roller 16. This cleaner .38 scrapes off the toner remaining on the intermediate transfer belt 12 after the secondary transfer and collects it in the waste toner box 40.

A paper supply cassette 42 is detachably located under the printer 10. The sheets of paper S, which are stacked and housed in the paper supply cassette 42, are fed out to the conveyance path 46 one by one, beginning with the topmost sheet, via the rotation of the paper supply roller 44.

The conveyance path 46 extends to the paper eject tray 11 while passing the paper supply cassette 42, the nipping area (contact area) 49 formed by the timing rollers 48, the secondary transfer area 36 and the fusing unit 50. The timing rollers 48 comprise a conveyance roller 48*a* and a roller 48*b*, and the conveyance roller 48*a* is driven to rotate by the roller driving device 19.

Figure 2:
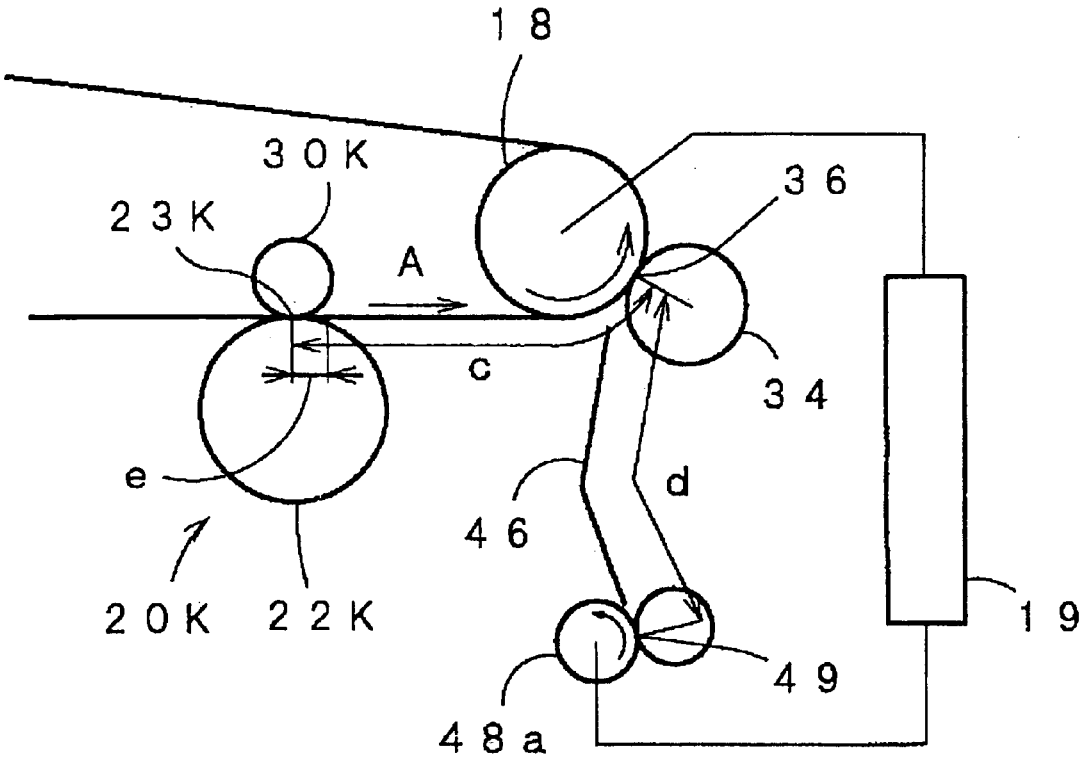
FIG. 2 is a drawing showing the positional relationships of the black-image forming unit and the timing rollers relative to the transfer area.

In the printer 10, as shown in FIG. 2, the black image forming unit 20K and the conveyance roller 48*a* are located in relation to the secondary transfer roller 34 such that the distance (the first distance) c from the image forming position 23K of the image forming unit 20K at which the unit forms an image on the intermediate transfer belt 12 to the transfer area 36 is slightly longer by a difference e (approximately 10 to 20 mm) than the distance (the second distance) d from the nipping area (contact area) 49 at which the conveyance roller 48*a* comes into contact with the sheet S to the transfer area 36.

Referring to FIG. 1 once more, a paper supply sensor 52 is located near the timing rollers 48. The paper supply sensor 52 detects that the top edge of the sheet S fed out from the paper supply cassette 42 to the conveyance path 46 has been grasped by the timing rollers 48. When the top edge of the sheet S is detected by the paper supply sensor 52, the timing rollers 48 stop their rotation, and the sheet S is thereafter fed out to the secondary transfer area 36 in synchronization with the toner image on the intermediate transfer belt 12.

The fusing unit 50 has a fusing belt 60 that is supported by a pair of rollers 56 and 58 and is driven to rotate in the direction of the arrow B, as well as a fusing roller 62 that is in pressure contact with the roller 56 via the fusing belt 60 and rotates in the direction of the arrow as the roller 56 rotates. The nipping area formed by the fusing belt 60 and the fusing roller 62, through which area passes the sheet that has undergone secondary transfer of the toner image, comprises the fusing area 64.

The operation of the printer 10 having the above construction will now be explained.

When image signals are input to the image signal processing unit (not shown in the drawings) of the printer 10 from an external device such as a personal computer, for example, the image signal processing unit prepares digital image signals comprising the original image signals converted into yellow, cyan, magenta or black digital signals, and these digital image signals are transmitted to the print head LED drive circuit. The drive circuit causes the print heads 26Y, 26M, 26C and 26K of the image forming units 20Y, 20M, 20C and 20K, respectively, to emit light for exposure based on the input digital signals. Exposure takes place sequentially in the order of print heads 26Y, 26M, 26C and 26K such that there is a time difference between each exposure session. Consequently, an electrostatic latent image of the each respective color is formed on the surfaces of the photoreceptor. drums 22Y, 22M, 22C and 22K, respectively.

Figure 3A:
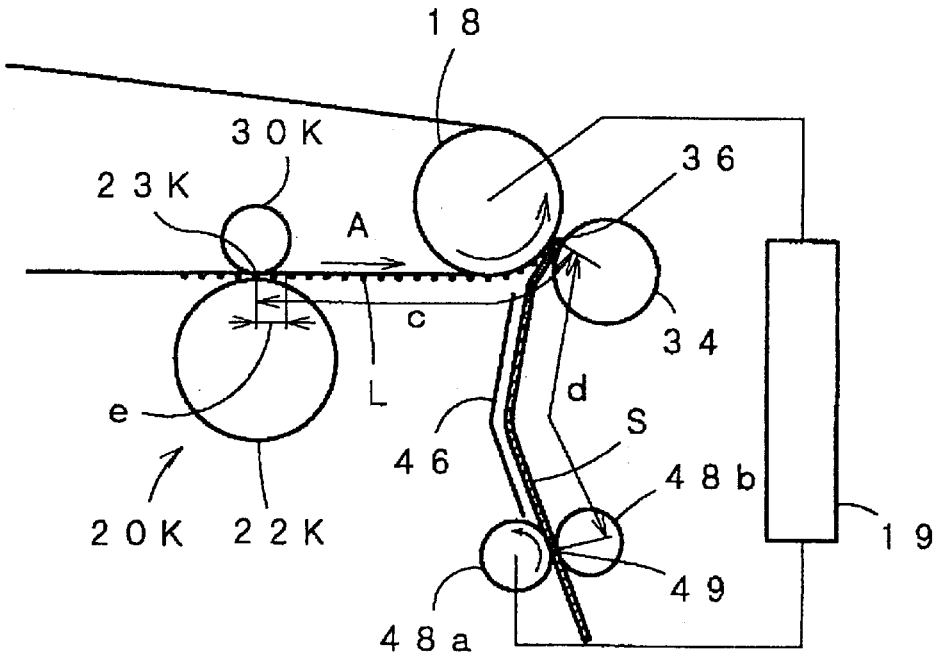
FIG. 3(*a*) is a drawing showing the black-image forming unit of FIG. 2 forming an image, and FIG. 3(*b*) is a drawing showing the timing rollers of FIG. 2 finishing the conveyance of the sheet.
Figure 3B:
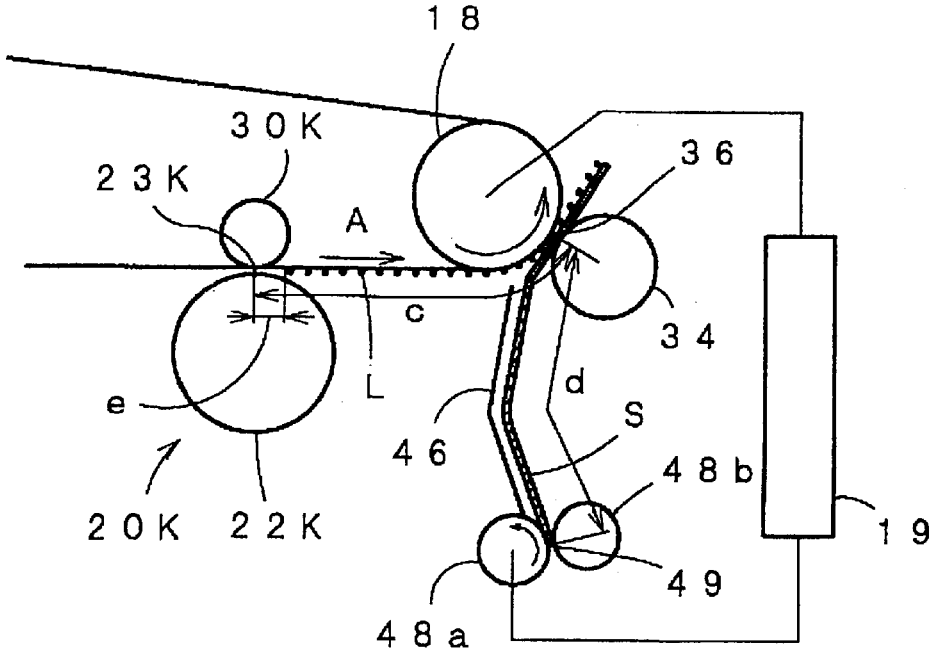

The electrostatic latent images formed on the photoreceptor drums 22Y, 22M, 22C and 22K are developed respectively by the developing unit 28Y, 28M, 28C and 28K into a toner image of each color. The toner image of each color undergoes primary transfer onto the intermediate transfer belt 12 that is moving in the direction of the arrow A, in a sequentially superimposed fashion based on the effect of each primary transfer roller 30Y, 30M, 30C and 30K. The combination toner image formed on the intermediate transfer belt 12 in this way reaches the secondary transfer area 36 as the intermediate transfer belt 12 continues to travel. On the other hand, the timing rollers 48 supply the sheet S sent out to the conveyance path 46 from the paper supply cassette 42 to the transfer area 36 via the rotation of the conveyance roller 48*a* in synchronization with the combination toner image. When this occurs, the timing rollers 48 grasp the sheet S until the image forming unit 20K completes the formation of an image L on the intermediate transfer belt 12, as shown in FIG. 3(*a*). When the tail edge of the sheet S leaves the nipping area 49, as shown in FIG. 3(*b*), the tail end of the image L formed on the intermediate transfer belt 12 by the image forming unit 20K has moved in the direction of the transfer area 36 from the image forming position 23K for the image forming unit 20K by the difference e (approximately 10 to 20 mm) between the distances c and d. Consequently, the roller 18, which is driven to rotate by the roller driving device 19, which is also the drive source for the conveyance roller 48*a*, experiences a change in the rotational rate when the tail edge of the sheet S leaves the nipping area 49, but because the operation to form the image L by the image forming unit 20K has already been completed, no image disturbance, which may result in incomplete overlap of the single-color toner images, takes place due to the above change.

Referring back to FIG. 1 once more, the multi-color combination toner image undergoes secondary transfer onto the sheet S at one time at the secondary transfer area 36 based on the effect of the secondary transfer roller 34. The toner remaining on the intermediate transfer belt 12 after secondary transfer is collected by the cleaner 38.

The sheet S on which the combination toner image has been transferred via secondary transfer is sent to the fusing unit 50 through the conveyance path 46, and the combination toner image is fused onto the sheet S when the sheet S passes through the fusing area 64. The sheet S is then ejected onto the paper eject tray 11.

The intermediate transfer member comprised a belt in the above embodiment, but it may have a different configuration such as a drum.

Further, the explanation regarding this embodiment was given using a printer as an example, but the present invention may be applied in a different type of image forming apparatus, such as a copying machine, a facsimile machine, or a combination machine comprising a copying machine and/or a facsimile machine and/or printer.

Although the present invention has been fully described by way of examples, it is to be noted that various changes and modification will be apparent to those skilled in the art. Therefore, unless otherwise such changes and modifications depart from the scope of the present invention, they should be construed as being included therein.

What is claimed is:

1. A color image forming apparatus comprising:

an intermediate transfer belt being supported by a plural rollers including a driving roller and being driven to rotate by the driving roller;

a first image forming unit being located below the intermediate transfer belt, and forming a first toner image of a first color on the intermediate transfer belt at a first image forming position;

a second image forming unit being located below the intermediate transfer belt and being located downstream of the first image forming unit relative to the movement of the intermediate transfer belt, the second image forming unit forming a second toner image of a second color over the first toner image formed on the intermediate transfer belt at a second image forming position;

a third image forming unit being located below the intermediate transfer belt and being located downstream of the second image forming unit relative to the movement of the intermediate transfer belt, the third image forming unit forming a third toner image of a third color over the first and second toner images formed on the intermediate transfer belt at a third image forming position;

a fourth image forming unit being located below the intermediate transfer belt and being located downstream of the third image forming unit relative to the movement of the intermediate transfer belt, the fourth image forming unit forming a fourth toner image of a fourth color over the first, second and third toner images formed on the intermediate transfer belt at a fourth image forming position;

a transfer roller for transferring the superposed toner images formed on the intermediate transfer belt onto a sheet of paper in a transfer area, the transfer roller being disposed so as to press against the part of the intermediate transfer belt supported by the driving roller; and a pair of rotatable conveyance rollers for conveying the paper to the transfer area in synchronization with the superposed toner images on the intermediate transfer belt, wherein a first distance from the fourth image forming position for the fourth image forming unit to the transfer area is longer than a second distance from a nipping area formed by the pair of conveyance rollers to the transfer area.

2. The color image forming apparatus of claim 1, comprising a roller driving device for supplying rotational torque to the driving roller and the conveyance rollers.

3. The color image forming apparatus of claim 1, wherein the difference between the first and second distances is approximately 10 to 20 mm.

4. The color image forming apparatus of claim 1, wherein the fourth color of the fourth toner image is black.

5. The color image forming apparatus of claim 1, wherein the plural rollers include the driving roller and a first roller located at the opposite side of the driving roller, a cleaner being disposed so as to press against the part of the intermediate transfer belt supported by the first roller.

6. The color image forming apparatus of claim 5, wherein the plural rollers include the driving roller, the first roller and a second roller which is located downstream of the driving roller relative to the movement of the intermediate transfer belt and is located upstream of the first roller relative to the movement of the intermediate transfer belt.

7. The color image forming apparatus of claim 5, wherein the first image forming unit, the second image forming unit, the third image forming unit and the fourth image forming unit are located below the intermediate transfer belt between the driving roller and the first roller, the first through the fourth image forming units being located downstream of the first roller relative to the movement of the intermediate transfer belt and being located upstream of the driving roller relative to the movement of the intermediate transfer belt.

8. The color image forming apparatus of claim 5, wherein the pair of rotatable conveyance rollers are located below the transfer area.

9. The color image forming apparatus of claim 8, comprising:

a paper supply device for supplying the paper to the pair of rotatable conveyance rollers, the paper supplying device being located below the first through the fourth image forming units;

and a fixing unit for fixing the superimposed toner images transferred on the paper by the transfer roller, the fixing unit being located above the transfer area.

10. The color image forming apparatus of claim 9, comprising a discharged paper tray for discharging the paper on which the superimposed toner images are fixed by the fixing unit, the discharged paper tray being located above the intermediate transfer belt.

11. A color image forming apparatus comprising:

an intermediate transfer member being driven to rotate by a driving roller;

plural image forming units for forming superposed toner images on the intermediate transfer member, the plural image forming units being located below the intermediate transfer member;

a transfer member for transferring the superposed toner images formed on the intermediate transfer member onto a sheet of paper in a transfer area; and a pair of rotatable conveyance rollers for conveying the paper to the transfer area in synchronization with the superposed toner images on the intermediate transfer member, wherein a first distance from an image forming position, for the image forming unit located most-downstream in the plural image forming units relative to the movement of the intermediate transfer member, to the transfer area is longer than a second distance from a nipping area formed by the pair of conveyance rollers to the transfer area.

12. The color image forming apparatus of claim 11, comprising a roller driving device for supplying rotational torque to the driving roller and the conveyance rollers.

13. The color image forming apparatus of claim 11, wherein the difference between the first and second distances is approximately 10 to 20 mm.

14. The color image forming apparatus of claim 11, wherein the image forming unit located most-downstream in the plural image forming units relative to the movement of the intermediate transfer member forms a black toner image on the intermediate transfer member.

15. The color image forming apparatus of claim 11, wherein the intermediate transfer member is supported by a plural rollers including the driving roller and a first roller located at the opposite side of the driving roller, the transfer member being disposed so as to press against the part of the intermediate transfer member supported by the driving roller, a cleaner being disposed so as to press against the part of the intermediate transfer member supported by the first roller.

16. The color image forming apparatus of claim 15, wherein the plural image forming units are located below the intermediate transfer member between the driving roller and the first roller, the plural image forming units being located downstream of the first roller relative to the movement of the intermediate transfer member and being located upstream of the driving roller relative to the movement of the intermediate transfer member.

17. A color image forming apparatus comprising:

an intermediate transfer member being driven to rotate by a driving roller;

a plural image forming units for forming superposed toner images on the intermediate transfer member, the plural image forming units being located below the intermediate transfer member;

a transfer member for transferring the superposed toner images formed on the intermediate transfer member onto a sheet of paper in a transfer area; and a pair of rotatable conveyance rollers for conveying the paper to the transfer area in synchronization with the superposed toner images on the intermediate transfer member, wherein the image forming unit located most-downstream in the plural image forming units relative to the movement of the intermediate transfer member completes image formation on the intermediate transfer member before a tail edge of the paper passes the conveyance rollers.

18. The color image forming apparatus of claim 17, comprising a roller driving device for supplying rotational torque to the driving roller and the conveyance rollers.

19. The color image forming apparatus of claim 17, wherein the intermediate transfer member is supported by a plural rollers including the driving roller and a first roller located at the opposite side of the driving roller, the transfer member being disposed so as to press against the part of the intermediate transfer member supported by the driving roller, a cleaner being disposed so as to press against the part of the intermediate transfer member supported by the first roller.

20. The color image forming apparatus of claim 19, wherein the plural image forming units are located below the intermediate transfer member between the driving roller and the first roller, the plural image forming units being located downstream of the first roller relative to the movement of the intermediate transfer member and being located upstream of the driving roller relative to the movement of the intermediate transfer member.

* * * * *